US005560338A

United States Patent [19]

Herdin et al.

[11] Patent Number: 5,560,338

[45] Date of Patent: Oct. 1, 1996

[54] APPARATUS FOR SENSING THE ENGINE PARAMETERS OF AN INTERNAL COMBUSTION ENGINE

[75] Inventors: Günther Herdin, Jenbach; Ingobert Adolf, Innsbruck, both of Austria; Michael Hötger, Berlin, Germany; Walter Picker, Schwaz; Franz Pockstaller, Henbach, both of Austria

[73] Assignee: Jenbacher Energiesysteme Aktiengesellschaft, Jenbach, Austria

[21] Appl. No.: 560,201

[22] Filed: Nov. 21, 1995

Related U.S. Application Data

[63] Continuation of Ser. No. 307,565, Sep. 19, 1994, Pat. No. 5,505,177.

[51] Int. Cl.[6] ..... F02M 7/10

[52] U.S. Cl. ..... 123/435

[58] Field of Search ..... 123/435, 414, 123/425, 613, 494, 416; 73/35, 116; 250/227, 578; 364/431.08

[56] References Cited

U.S. PATENT DOCUMENTS 4,381,748 5/1983 Eckert et al. ..... 123/414
5,103,789 4/1992 Hartman et al. ..... 123/435
5,113,828 5/1992 Remboski et al. ..... 123/425
5,125,381 6/1992 Nutton et al. ..... 123/425
5,505,177 4/1996 Herdin et al. ..... 123/435

*Primary Examiner*—Raymond A. Nelli
*Attorney, Agent, or Firm*—Lorusso & Loud

[57] ABSTRACT

An arrangement for determining the parameters of an internal combustion engine, in particular an Otto engine operating with gaseous fuels, has at least one optical sensor for observing the emission of light caused by the combustion in a combustion chamber of the internal combustion engine and at least one photodetector for converting the light emitted into electric signals which are processed in an evaluation unit. In order to achieve a rapid and accurate regulation, the evaluation unit has an arrangement for determining the maximum or mean intensity of the light emitted during each combustion cycle on the basis of the corresponding electric signal. The evaluation unit further has a regulating unit which regulates at least one engine parameter depending on the intensity maxima.

3 Claims, 3 Drawing Sheets

APPARATUS FOR SENSING THE ENGINE PARAMETERS OF AN INTERNAL COMBUSTION ENGINE

Figure 1:
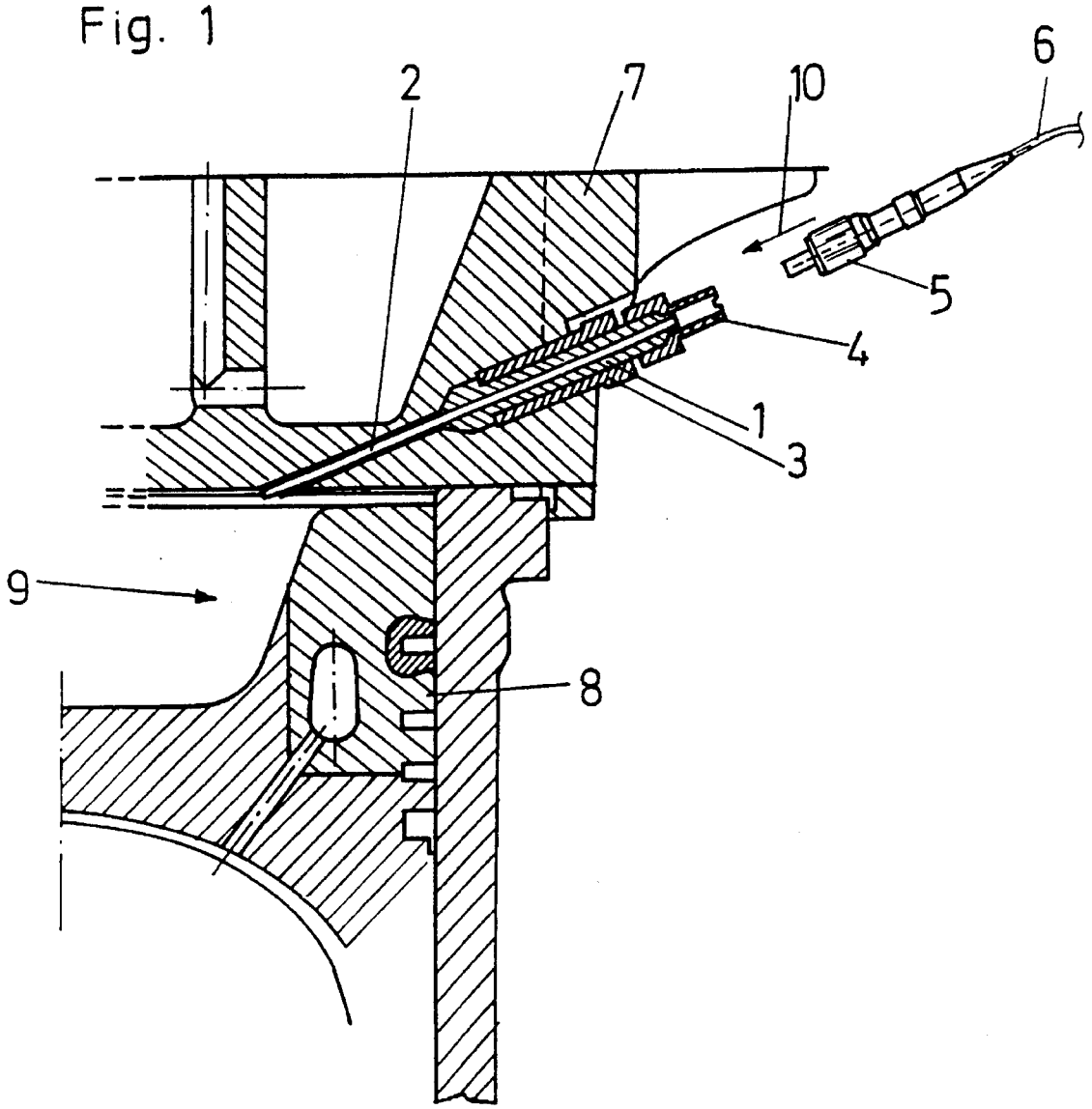

This is a continuation of copending application Ser. No. 08/307,565 filed on Sep. 19, 1994. International Application AT93/00164 filed on 27 Oct. 1993 and which designated the U.S.

The invention relates to an apparatus for sensing engine parameters of an internal combustion engine, in particular a four-stroke engine driven by gaseous fuels, with at least one optical sensor for observing the light emission caused by combustion in a combustion chamber of the internal combustion engine, and with at least one photo-sensor for converting the light emission into electrical signals which are processed in a processing apparatus.

The use of the light emission produced by combustion in a combustion chamber to control engine parameters has previously been proposed. The light is conducted from the engine, without affecting the rest of the combustion process, by means of an optical sensor which is attached to the engine and is generally a light-conducting element leading into the combustion chamber (in the simplest case a so-called combustion chamber window). The optical sensor can also be integrated into the spark plugs.

Until now a control signal for controlling the ignition timing has mainly been obtained from the state of the light emission over a period of time.

A control apparatus for an engine is known from DE-OS 35 05 063, in which the difference between the maximum value of the light intensity and an average value formed from several maximum values represents the regulating variable. With this subtraction, the information about the absolute value of the maximum value is lost. The known control system in the end acts to control running disturbances in the engine. Which engine parameters, in particular which fuel-air ratio (Lambda) produces the desired smooth running is irrelevant in this case. There is thus no control directed towards a specific fuel-air ratio.

The object of the invention is to provide an apparatus of the type described in the introduction, with which it is possible to precisely control at least one engine parameter.

According to the invention this is solved with an apparatus of the type described in the introduction, in that the processing apparatus includes a system for determining the maximum intensity of the light emission of each combustion cycle from the corresponding electrical signals and the processing apparatus further includes a control unit, which controls at least one engine parameter dependent upon the maxima of intensity.

Whereas with the known proposals the state of the light emission is evaluated over a period of time, according to the invention it is proposed that the magnitude of the maximum intensity of the light emission be used to sense an engine parameter and preferably to control engine parameters by means of a control unit. Such an engine parameter is, in particular, the fuel-air ratio (Lambda). However, other engine parameters such as, for example, ignition timing, compression, engine temperature and so on can also be controlled essentially dependent upon the maximum intensity or integral value of the intensity of the light emission of each combustion cycle. The maximum of the light emission which is reflected in the electrical signal of the photo-sensor can easily be determined by an electronic processing apparatus and be supplied to the actual value input of a control system, which then controls or adjusts at least one engine parameter dependent thereupon.

In order to smooth out variations in the light emission in individual successive combustion cycles, it is advantageous when the apparatus for determining the maximum of intensity is connected on the output side to an averaging device, which supplies a signal corresponding to the average value of the maxima of intensity of a pre-determinable number of combustion cycles, and that the output of the averaging device is connected to the actual value input of the control unit. The maximum intensity can in this way be averaged over, for example, 20 to 100 cycles.

A further preferred embodiment is characterised in that the processing apparatus is provided with an apparatus for sensing combustion misfires, which receives on the one hand signals in connection with the light emission, and on the other hand signals from a sensor which are dependent upon the crankshaft angle and the position of the piston of the engine, which, upon receiving an electrical signal below a threshold value at a point in time or time window dependent upon the crankshaft angle or the position of the piston, during which ignition normally takes place, supplies an output signal at its output. The signals output from the apparatus for sensing combustion misfires can, for example, be counted, and when there is a certain number or frequency of combustion misfires can, for instance, cause an emergency shut-off of the engine.

It is furthermore possible to supply the signals from the apparatus for sensing combustion misfires to the averaging device. This can simply ignore combustion cycles with combustion misfires in order to avoid false averages. It has been shown, particularly in the examination of gas engines, that the radical occurring during ignition emits light in a specific frequency range, particularly in the ultra-violet region (circa 200 nm to 350 nm). Using an optical band-pass filter, which is preferably connected on the input side of the photo-sensor, a certain spectral region —a so-called spectral window—can specifically be evaluated, and the maximum light emission occurring in this spectral window used for controlling engine parameters. It has been shown that in the case of a gas engine the intensity of the radiation in the UV region is greatly dependent upon the combustion gas-air ratio, wherein when there are lower lambda values, a greater intensity occurs. This can be used to obtain control of the lambda on the basis of the light intensity of the UV emission. At the same time it is naturally also possible to control other engine parameters, for example the ignition timing, on the basis of the light emission of each combustion cycle.

From a constructional point of view, it is particularly advantageous when a band-pass filter, preferably a coloured glass filter, is arranged in or on the optical sensor, wherein, for example, by using specially doped types of glass it is possible for the material which conducts light from the combustion chamber to itself have band-pass filtering properties, and thereby be able to form one band-pass filter per combustion chamber, when this is desired.

A further advantageous embodiment of the invention is that in the case of a multi-cylinder combustion engine, in order to control the engine parameters selectively per cylinder, an optical sensor is arranged on the combustion chamber of each cylinder, to which a separate photo-sensor and a separate processing apparatus with a control unit belong, which controls the engine parameters of the respective cylinder dependent upon the electrical signals corresponding to the light emission of the respective cylinder and adjustable specified values. Control of engine parameters cylinder selectively, for example of the fuel-air ratio for each individual cylinder, allows a more precise control and mode of operating of the engine. It is naturally also essentially conceivable and possible to simultaneously control one or more engine parameters for several combustion chambers dependent upon the light emission of at least one combustion chamber.

Further advantages and details of the invention will be described in more detail in the following description of the drawings.

Figure 2:
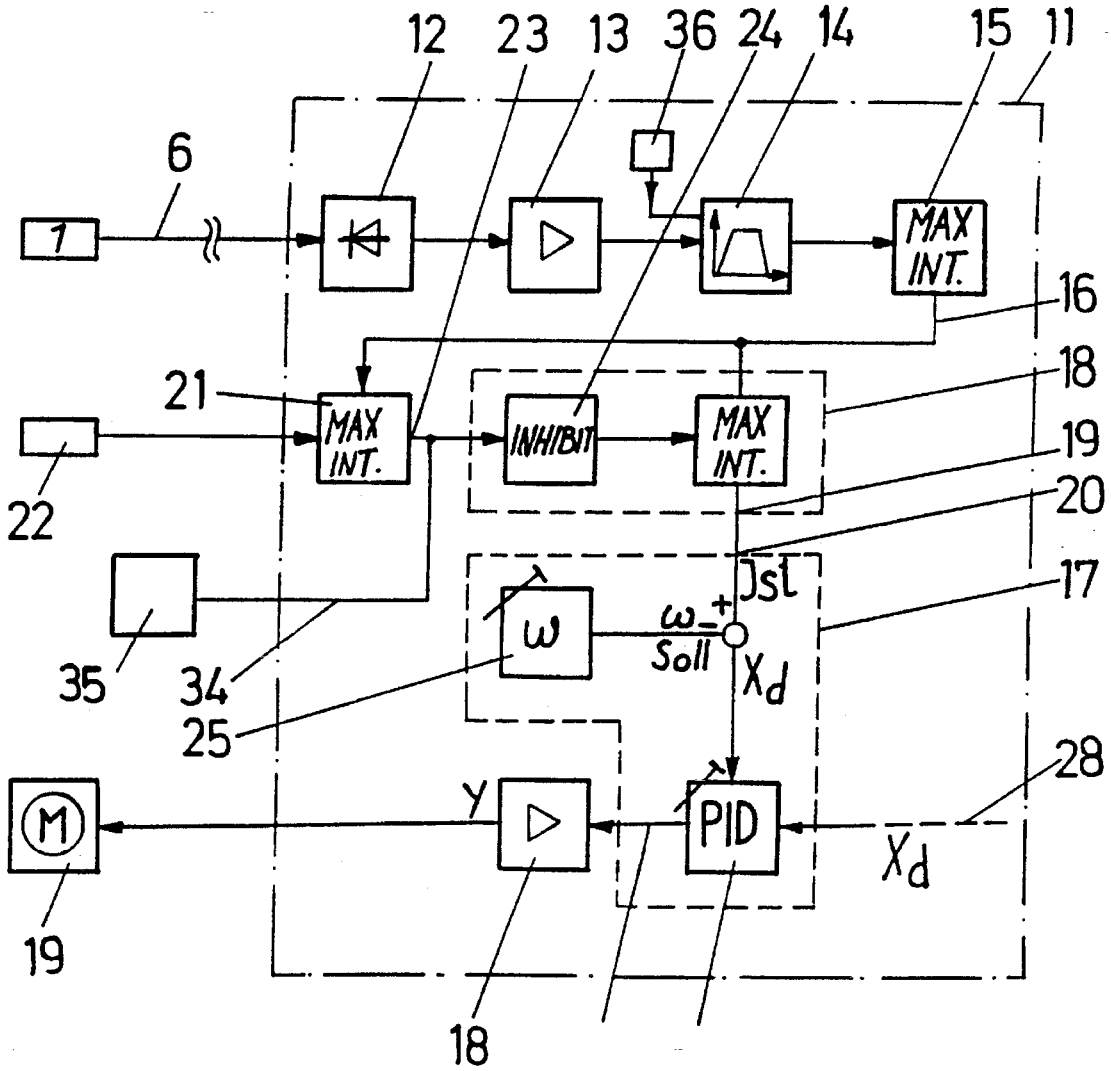
Figure 3:
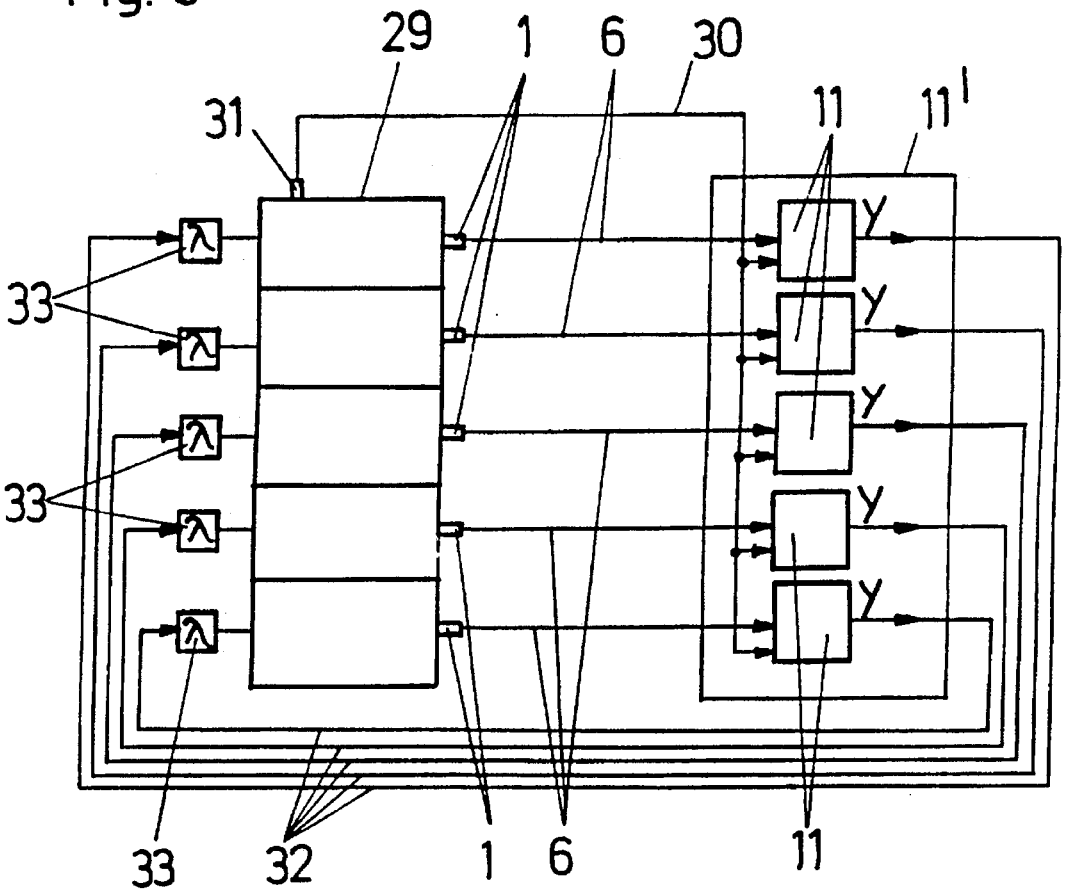
Figure 4:
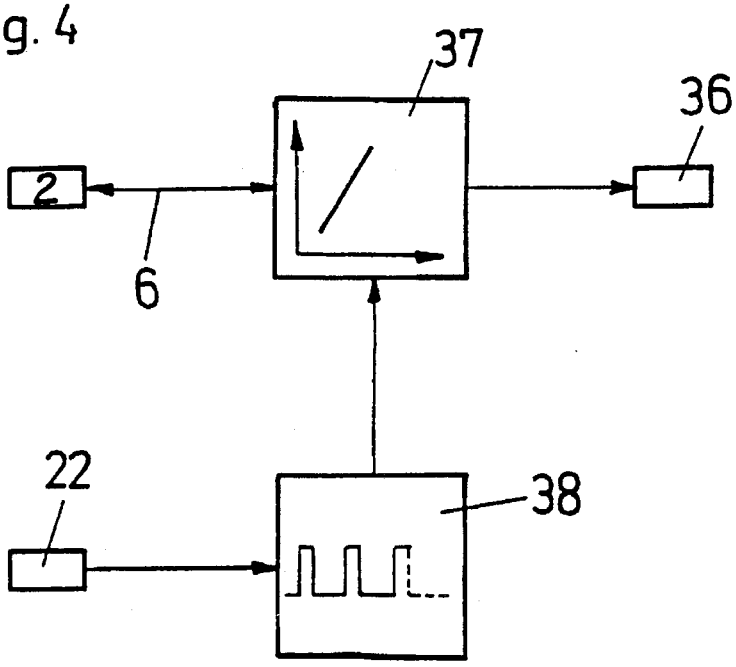

FIG. 1 shows a schematic cross-section through the cylinder head region of a cylinder with an optical sensor fitted, FIG. 2 shows in a block diagram the processing apparatus for an embodiment of the invention, and FIG. 3 shows schematically a multi-cylinder internal combustion engine with cylinder-selective combustion gas-air mixture control dependent upon the light emission from the individual combustion chambers. FIG. 4 shows an automatic calibrating device in a block diagram.

The optical sensor (probe) designated as a whole as 1 is fitted in the cylinder head 7 of a cylinder of an internal combustion engine and held by means of a cap nut 3. The optical sensor 1 includes a light-conducting glass rod 2, which extends into the combustion chamber 9 above the piston 8. Additionally the optical sensor includes an optical fibre plug adaptor 4, which makes it possible to removably connect an optical fibre, particularly in the form of a flexible light conducting fibre 6 onto the external end of the glass rod 2 by means of an optical fibre plug 5. For this, the optical fibre plug 5 has simply to be plugged in in the direction of the arrow 10 into the optical fibre plug adaptor 4. It is in this way possible to then supply the light which occurs during combustion in the combustion chamber 9 to a processing apparatus, firstly by means of the glass rod 2 and then by means of the flexible optical fibre 6. The flexible optical fibre allows the electronic processing apparatus to be positioned at a distance, and if damage occurs it can easily be replaced.

FIG. 2 is an embodiment of such a processing apparatus 11. The light from a combustion chamber captured by an optical sensor is supplied to the electronic processing apparatus 11 by means of an optical fibre 6 (for example, conductive specially for the UV region). The optical fibre 6 can also be removably connected to the processing apparatus. At the input of the processing apparatus a photo-sensor 12 (for example a UV photo-diode with a spectral sensitivity range of 185 to 1,150 nm) converts the light into electrical signals, which are then amplified in an amplifier 13 and filtered in a high-pass or band-pass filter. The electrical signals corresponding to the light emission then arrive at an apparatus 15 for determining the maximum intensity of the light emission of each combustion cycle. The output signal present on the line 16 thus reflects the maximum intensity of the light emission of each combustion cycle, wherein for example a high-pass or band-pass filter can be integrated into the optical sensor itself, simply to observe a spectral window. The filter can be formed by the glass rod 2, which is composed of special glass. It is also possible, however, to fit a separate filter element. During measurements it has been shown inter alia that the radicals occurring during ignition emit light in the ultraviolet region (circa 200 nm to 350 nm). The intensity of this radiation is very greatly dependent upon the lambda (high intensity when there is low lambda). In this way a relatively precise lambda control can be effected on the basis of the light intensity of the UV emission. Furthermore, knocking can be detected by means of UV emission.

Wave lengths of about 600 nm (solid state radiators) also behave in this way, wherein these wave lengths are significantly easier to transmit and to detect. Detection of knocking is however more difficult with these wavelengths as the solid state persists when there is knocking and the higher frequency information on the knocking is thus partially lost. As a compromise it is advantageous to effectively observe a wavelength window of approximately 185 to 600 nm. As the UV photo-diode is in any case non-sensitive below 185 nm, an optical high-pass filter which is conductive only for wavelengths of less than 600 nm is sufficient therefor.

The signal present on the line 16 could essentially be supplied directly to the control unit 17, which then controls an engine parameter (for example the fuel-air ratio) by means of an output amplifier 18 and an engine parameter adjustment apparatus (for example a mixture adjustment apparatus 19). In order to smooth out variations in the individual combustion cycles, it is however more advantageous when the output signals on the line 16 are averaged over several, for example 10 to 100, cycles, for example 30 cycles, that is to say the average value of the maxima of intensity over a pre-determinable number of combustion cycles is determined. This is performed in the averaging device 18, the output 19 of which is connected to the actual value input 20 of the control unit 17.

As an alternative to the embodiment described, instead of the maximum value the integral value of the light intensity during the combustion period can be used for averaging. The signals of both procedures are actually identical, however the integral values show a smoother progression over the lambda than the peak values (=maximum values). However, more complex processing is required to obtain the integral values.

Probe drift (for example due to soiling of the combustion chamber probe) can be compensated for by an automatic calibrating device which, for example, acts on an additional input 36 of the amplifier 14 to correct drift. During engine operation soiling can be sensed with this apparatus and a respective correction signal produced (FIG. 4).

A light impulse is fed, angular marker controlled, into the optical fibre by the automatic calibrating device 37. This light impulse continues via the optical fibre 6 and the combustion chamber window 6 to the combustion chamber, from where it is reflected. The reflected impulse subsequently arrives again at the automatic calibrating device 37. The intensity of the reflected impulse is a measure of the soiling of the combustion chamber window. By means of this value, for example, the processing apparatus can be corrected (input 36). The automatic calibration procedure is always initiated by the automatic calibration triggering device 38 when no combustion is taking place (for example TDC change-over or during compression). This relates to the same combustion chamber window and the same optical fibres as described for the above processing unit. The processing apparatus and the automatic calibrating apparatus are isolated by means of an optical system.

Furthermore, in FIG. 2 an apparatus for sensing combustion misfires is provided, which receives on the one hand signals in connection with the light emission by means of the line 16, and on the other hand signals from a sensor 22 which are dependent upon the crankshaft angle and the piston position in the engine. Sensors for recognising the crankshaft angle or the piston position in the engine are well known to the man skilled in the art, and do not need to be described here in more detail. Generally they provide a certain trigger signal when there is a certain engine condition. The apparatus 21 for recognising combustion misfires then examines whether a light emission occurs in a certain time window established by the trigger signal from the sensor 22. With successful ignition this must be the case. If for once it is not the case, it outputs a corresponding signal at its output 23, which indicates a combustion misfire. This signal can be fed to an "inhibit" logical unit in the averaging device 18, which acts so that for averaging, any combustion cycle in which combustion misfires occur is ignored. In this way there is no error in the average value caused by individual combustion misfires.

Combustion misfires can also be notified to the emergency shut-off apparatus 35 by means of the line 34, which shuts off the engine when there is a certain frequency of combustion misfires.

The part of the processing apparatus substantially composed of parts 1, 6, 12, 13, 14, 15 (and if applicable 18) forms an "optical lambda probe", which, dependent upon the absolute value of the fuel-air ratio delivers a corresponding analog signal at the output 19. A lambda probe of this type can also be marketed and fitted independently of the following control unit. It is naturally also possible, however, to implement the electrical components of the lambda probe and the control unit 17 together.

The control unit 17 includes a setpoint device 25 by means of which the desired set value of the engine parameter can be determined. By comparison of the set value w determined with the actual value x (maximum intensity in a spectral window determined over several cycles), an error signal xd is given. This is fed to the stage 26 which then outputs an actuating signal for the control of an engine parameter. In this way the control loop is closed.

As indicated by the dashed line 28, error signals xd of several optical sensors 1 can be connected to the stage 14. This stage then takes, for example, the largest value of all the error signals connected to calculate the correcting variable y. As an example in the case of a multi-cylinder internal combustion machine which is only equipped with a single gas-air mixer, the combustion gas-air ratio can be controlled dependent upon the light emission in all the cylinders.

Cylinder-selective control is however also conceivable and advantageous as shown, for example in FIG. 3. As an example, a five-cylinder combustion engine 29 is shown therein. The optical sensors 1, which are connected to the electronic processing apparatus 11' by means of flexible optical fibres 6, extend into the combustion chamber of each cylinder. This electronic processing apparatus 11' substantially includes five processing apparatuses 11 as are shown in FIG. 2. Each of these processing apparatuses 11 receives a signal sensed by a sensor 31, by means of a line 30, revealing the crankshaft angle. A cylinder-selective controlling of engine parameters is carried out by means of the processing apparatuses 11, in the case of the embodiment shown in FIG. 3 of the combustion gas- air ratio of each individual cylinder. For this, from each processing apparatus 11 a control line 32 leads to the individual apparatuses 33 for adjusting the combustion gas-air ratio. It is thus possible using this apparatus to cylinder-selectively control certain engine parameters dependent upon the light emission of each combustion cycle.

We claim:

1. An apparatus for calibrating an optical sensor in an internal combustion engine comprising a light source for transmitting light through said optical sensor into said combustion chamber, and a sensor for sensing a portion of said light which reflects from said combustion chamber back into said optical sensor.

2. An apparatus according to claim 1, wherein said light source is arranged outside of said combustion chamber.

3. An apparatus according to claim 2, wherein said light source is connected to said optical sensor by means of an optical fiber.

* * * * *